US005373096A

United States Patent [19]

Suzuki et al.

[11] Patent Number: 5,373,096

[45] Date of Patent: Dec. 13, 1994

[54] MUSICAL SOUND CONTROL DEVICE RESPONSIVE TO THE MOTION OF BODY PORTIONS OF A PERFORMER

[75] Inventors: Hideo Suzuki; Masao Sakama, both of Hamamatsu, Japan

[73] Assignee: Yamaha Corporation, Japan

[21] Appl. No.: 44,568

[22] Filed: Apr. 8, 1993

Related U.S. Application Data

[63] Continuation of Ser. No. 537,336, Jun. 12, 1990.

[30] Foreign Application Priority Data

Jun. 14, 1989 [JP] Japan ..... 1-69577[U]
Jun. 14, 1989 [JP] Japan ..... 1-69578[U]

[51] Int. Cl.[5] ..... G10H 1/34

[52] U.S. Cl. ..... 84/600; 84/615; 84/626; 84/644; 128/782

[58] Field of Search ..... 84/600, 615, 676, 626, 84/644, 687, 734, 742, DIG. 24; 128/782; 338/13, 162

[56] References Cited

U.S. PATENT DOCUMENTS

| | | | |
|---|---|---|---|
| 4,627,324 | 12/1986 | Zwosta | 84/600 |
| 4,905,560 | 3/1990 | Suzuki et al. | 84/600 |
| 4,977,811 | 12/1990 | Suzuki et al. | 84/600 |
| 5,005,460 | 4/1991 | Suzuki et al. | 84/600 |
| 5,022,303 | 6/1991 | Suzuki et al. | 84/600 |
| 5,125,313 | 6/1992 | Hiyoshi et al. | 84/600 |
| 5,151,553 | 9/1992 | Suzuki et al. | 84/600 |

FOREIGN PATENT DOCUMENTS 1250997 10/1989 Japan .

*Primary Examiner*—William M. Shoop, Jr.
*Assistant Examiner*—Jeffrey W. Donels
*Attorney, Agent, or Firm*—Graham & James

[57] ABSTRACT

The present invention provides a musical sound control device wherein, based on the movements of the fingers or other body parts of the performer, control of pitch bender and vibrato effects can easily achieved, and wherein the mobility and dexterity of each of the five digits of a human hand have been taken into careful consideration, whereby touch intensity musical control can be achieved.

The present invention provides detectors which can be applied to various portions of a performer's body, whereby movement of each body portion to which the detectors have been applied can be detected. Additionally, the present invention provides a control signal generator, whereby based on the output of the above mentioned detectors a musical control signal is generated. The above mentioned control signal generator includes a predetermined region wherein a musical control signal is not generated to impart a desirable effect on a musical tone, and in the other region, the control signal therefor carries out touch intensity conversion for the movement of each of the operators digits.

17 Claims, 11 Drawing Sheets

MUSICAL SOUND CONTROL DEVICE RESPONSIVE TO THE MOTION OF BODY PORTIONS OF A PERFORMER

This is a continuation of copending U.S. patent application Ser. No. 07/537,336 filed on Jun. 12, 1990 now abandoned.

BACKGROUND OF THE INVENTION

1. Field of the Invention

The present invention relates to musical sound control devices, and in particular, to musical sound control devices for which control is effected based on the movements of the fingers or other body parts of the performer.

2. Prior Art

With conventional musical instruments, for example, with a piano, a guitar, wind instruments, etc. , depending on the type of instrument and the desired sound, the individual playing the instrument plucks a string or rubs a bow against a string, depresses a key on a keyboard with a finger or thumb, blows into a mouth piece, or performs some other appropriate action, whereby control of the generation of musical sound is effected. In the majority of conventional electronic musical instruments as well, control is generally effected by depressing keys on a keyboard using a finger or thumb. When it is possible to effect musical sound control using a modality other than the conventional methods, that is, when it is possible to effect musical sound control by means other than playing on a keyboard, plucking a string, blowing into a mouthpiece, etc., it be comes possible to significantly alter the experience perceived by the operator of the musical instrument during a performance.

In consideration of the above, the present applicants have in the past proposed a musical sound control device in Japanese Patent Application Laid-Open No. Hei 1-250997 wherein a device for detecting motion of a portion of a performer's body is applied to one or more suitable portions of the body of the individual operating the musical instrument, whereby when the operator moves particular portions of his/her body, one or more signals are generated on which basis musical control is carried out. With such a device, control of pitch, volume, timbre, and various other parameters can be effected based on movements of the operators body. Such devices are applicable to dancers, performers simultaneously playing some kind of rhythm instrument, and the like.

As examples of detection means and their use with the above described type of musical sound control device, finger sensors can be applied to one or more of the performer's fingers and thumbs whereby control signals are generated based on the movement of the performer's digits . Similarly, elbow sensors can be applied to one or both of the performer's elbows, whereby control signals can be generated based on the movement of the performer's elbows. With this type of musical sound control device, the output signal of each sensor, for example of each finger sensor and/or elbow sensor in use, is supplied to a conversion unit wherein the output signal of the respective sensor is converted to a musical control signal. The musical control signals thus generated can then be supplied to a tone generation apparatus and/or various other auxiliary circuits. In this way, based on movements of the operators fingers, elbows, and/or possibly other body parts, musical control signals are generated whereby the pitch, timing, volume, timbre, and various other parameters of corresponding musical output generated in the tone generation apparatus can be controlled. As an example, such a musical sound control device could be set up so that when the performer's right thumb is flexed, a pitch corresponding to "do" is generated, when the performer's right index finger is flexed, a pitch corresponding to "re" is generated, etc.. Similarly, such a device could be set up so that to the extent the performer flexes his/her right elbow, control for a pitch bender effect of corresponding magnitude is carried out.

With this type of musical sound control device, however, in which pitch bender and vibrato effects are controlled on the basis of elbow movements, if the operator inadvertently flexes one of his elbows, an undesired pitch deviation or vibrato effect may result in the musical output. Similarly, when pitch control signals are generated on the basis of finger movements, finger motion that is imperceptible to the operator may result in the generation of unwanted musical tones. Additionally, with this kind of conventional musical sound control device, it is not possible to control the volume of generated tones based on the speed or force with which the operator flexes his/her fingers or thumbs.

SUMMARY OF THE INVENTION

In consideration of the above described shortcomings of conventional musical sound control devices, it is an object of the present invention to provide a musical sound control device whereby the control of pitch bender and vibrato effects can be easily achieved, and wherein the mobility and dexterity of each of the five digits of a human hand have been taken into careful consideration, whereby touch intensity musical control can be achieved.

To achieve this object, the present invention provides detection means which can be applied to various portions of a performer's body, whereby movement of each body portion to which the detection means has been applied can be detected. Additionally, the present invention provides a control signal generation means, whereby based on the output of the above mentioned detection means, a musical control signal is generated. Also provided is a musical tone generating means whereby musical tones are generated based on the above mentioned musical control signal. The above mentioned control signal generation means includes a predetermined region wherein a musical control signal is not generated. Furthermore, the control signal generation means carries out touch intensity conversion for the movement of each of the operators digits.

With the above described musical sound control device, when the control signal generation means is supplied a signal from a detection means corresponding to the above mentioned non-sensing region, control is not carried out for pitch bender and/or vibrato functions. Accordingly, it becomes much easier to carry out a musical performance in which unwanted pitch bender and/or vibrato functions have not been created. By virtue of the above mentioned touch intensity conversion carried out by the control signal generation means, because the mobility and dexterity of each of the five digits of the performer's hands have been taken into consideration, performances incorporating touch intensity musical control can be achieved.

DETAILED DESCRIPTION OF THE PREFERRED EMBODIMENTS

First Preferred Embodiment

Figure 1:
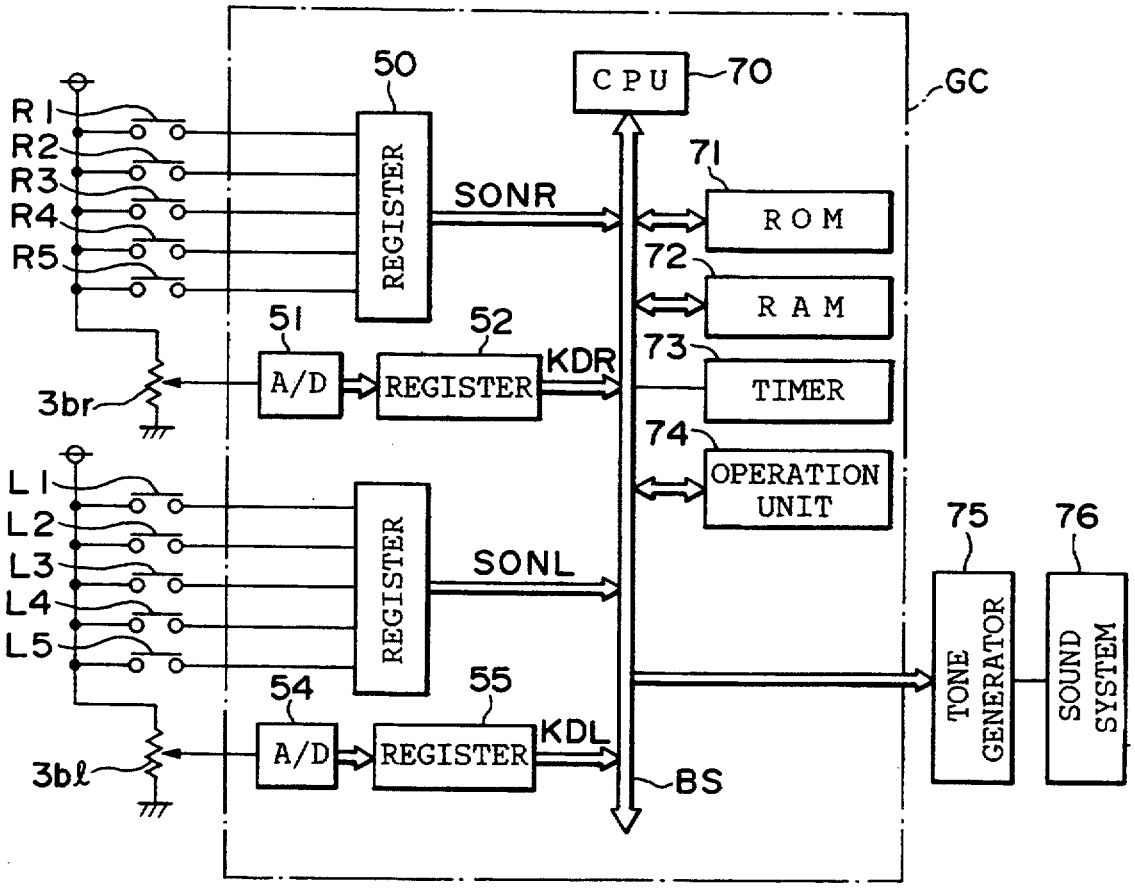
FIG. 1 is a block diagram showing the layout of a musical sound control device of a first preferred embodiment of the present invention.
Figure 10:
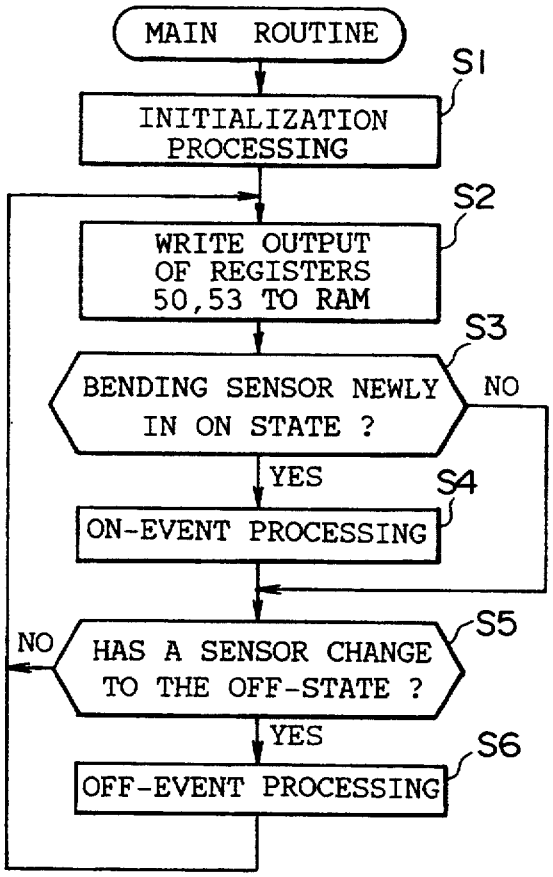
FIGS. 10 and 11 are flow charts illustrating the general operation of the musical sound control device of the first preferred embodiment of the present invention.
Figure 11:
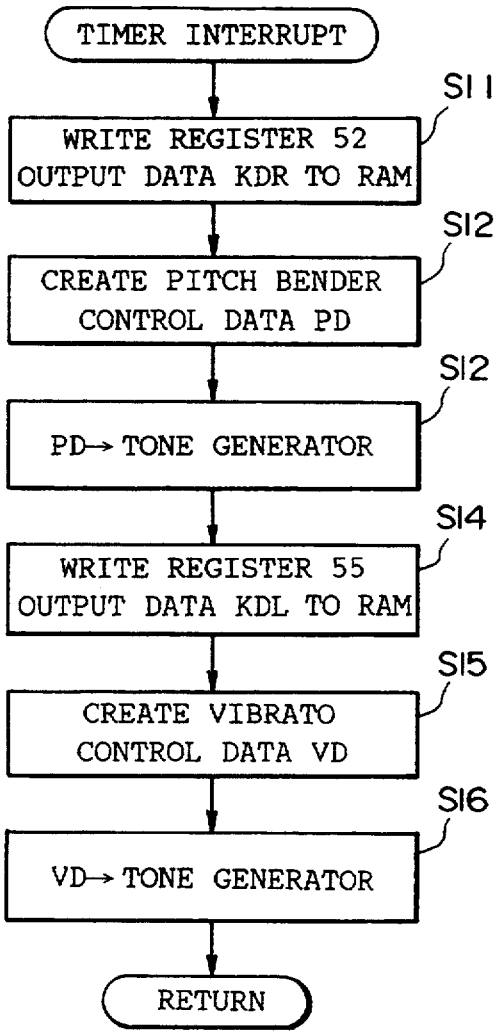

In the following, a first preferred embodiment of the present invention will be described with reference to FIGS. 1 through 11. In FIG. 1, a block diagram is presented showing the overall layout of the musical tone control device GC of the present embodiment. In FIGS. 2 through 9, various views of finger sensors and an elbow sensor employed in the present embodiment are presented. FIGS. 10 and 11 present flow charts demonstrating the operation of the present embodiment.

General Structure of the Sensors

Figure 2:
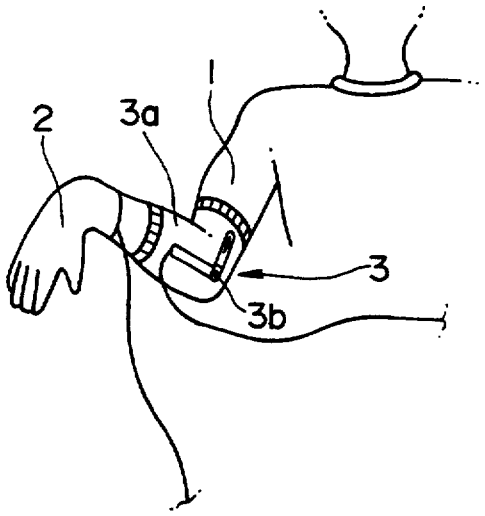
FIG. 2 shows finger sensors and an elbow sensor employed in the first preferred embodiment of the present invention applied to one hand and arm of a performer.

In FIG. 2, it can be seen that the right hand finger sensors 2 are provided as a glove type structure which fits over the operators right hand. The finger sensors 2 for each hand are made up of 5 bending sensors, one corresponding to each digit. The right elbow sensor 3 fits over the operators right elbow and adjacent portions of the operators right arm 1. Each elbow sensor 3 is made up of a sleeve 3*a* and an angle sensor 3*b*. The structure of finger sensors 2 and elbow sensor 3 will be described in greater detail in the following.

Structure of Finger Sensors

Figure 3:
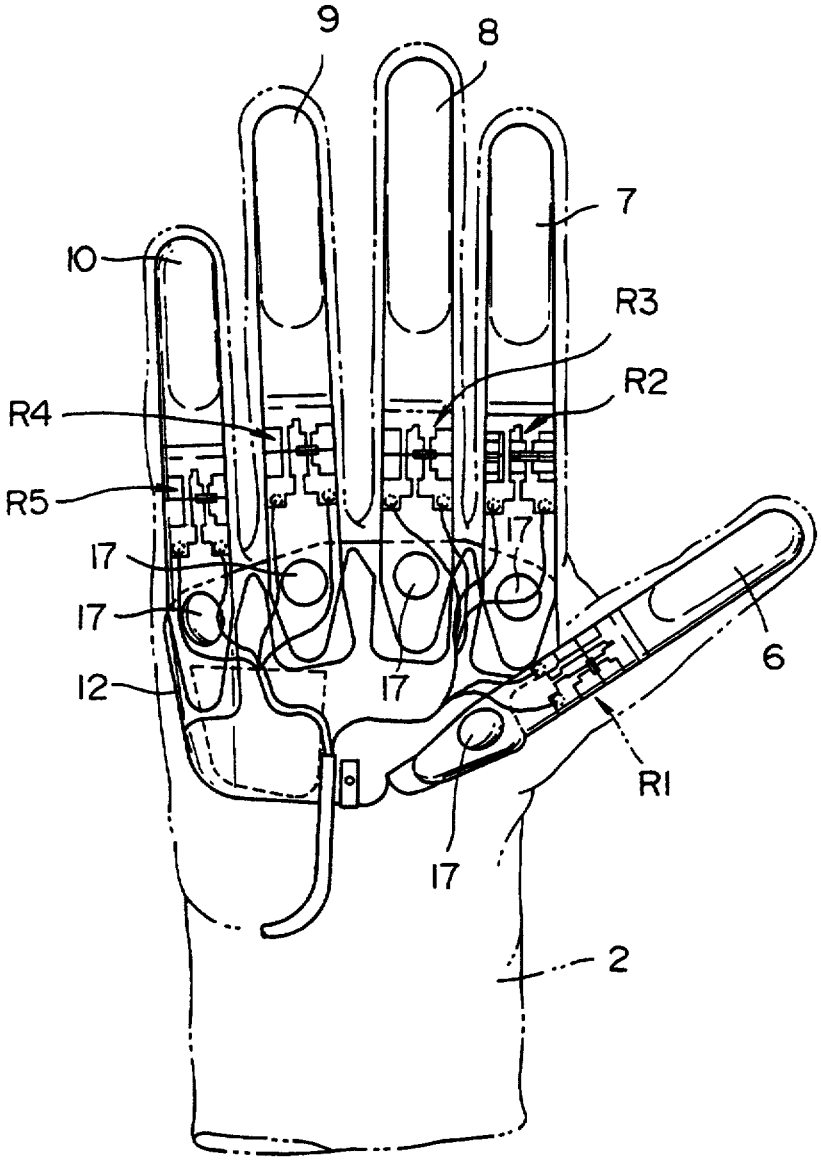
FIG. 3 is a plan view showing the finger sensors of the present invention for one hand.

As shown in the plan view of FIG. 3, finger contact plates 6–10 are provided for the thumb, index finger, middle finger, ring finger, and small finger respectively. Each of the five finger contact plates 6–10 is designed to conform with the respective digit with which it is in contact and each includes a transverse groove (not shown in FIG. 3) adjacent to the proximal inter-phalangeal articulation of the corresponding digit, whereby finger contact plate 6–10 can bend freely about the above mentioned groove with extension and flexion of the proximal inter-phalangeal articulation of each corresponding digit. A bending sensor R1–R5 is provided at the above mentioned groove of each of the five finger contact plates 6–10, respectively. Each of the bending sensors R1–R5 is in an [ON] state after the inter-phalangeal articulation of the corresponding digit has flexed beyond a predetermined angle, and returns to the [OFF] when the concerned digit again extends beyond the predetermined angle. The finger sensors 2 include a support plate 12 which is shaped to conform to the palm of a hand, and to which each of the five finger contact plates 6–10 are connected via respective pins 17.

Figure 4:
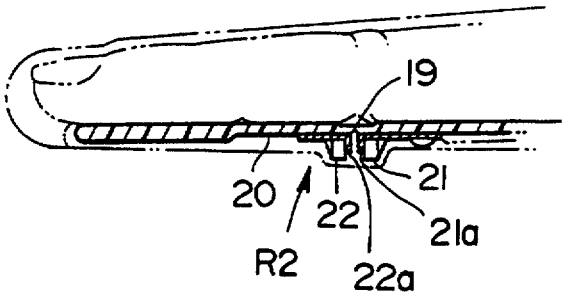
FIG. 4 is a side view showing the bending sensor employed in an index finger sensor of the present invention in a fully extended position.

In the following, the structure of the above mentioned bending sensors R1–R5 will be described. In FIG. 4, a side view of index finger bending sensor R2 is shown. The structure of the remaining four bending sensors R1, R3–R5 is the same.

Figure 5:
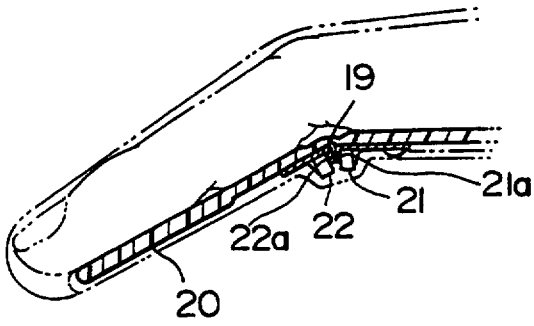
FIG. 5 is a side view of the bending sensor shown in FIG. 4 in a partially flexed position.

The above mentioned groove is shown for the index finger sensor in FIG. 4 as groove 19. A block 21, 22 is present along each of the two edges of groove 19, each block 21, 22 aligned parallel to groove 19 and extending downward, that is away from the overlying digit. An electrode 21*a*, 22*a* is provided on the opposing surfaces of blocks 21, 22 respectively. As is shown in FIG. 5, when the index finger sensor bends beyond a predetermined angle about groove 19, the electrodes 21*a*, 22*a* on the opposing surfaces of blocks 21, 22 come into contact, that is, the bending sensor R2 is in the [ON] state. Although not shown in the drawings, identical bending sensors L1–L5 are provided for each of the digits of the operators left hand.

Structure of Elbow Sensors

Figure 6:
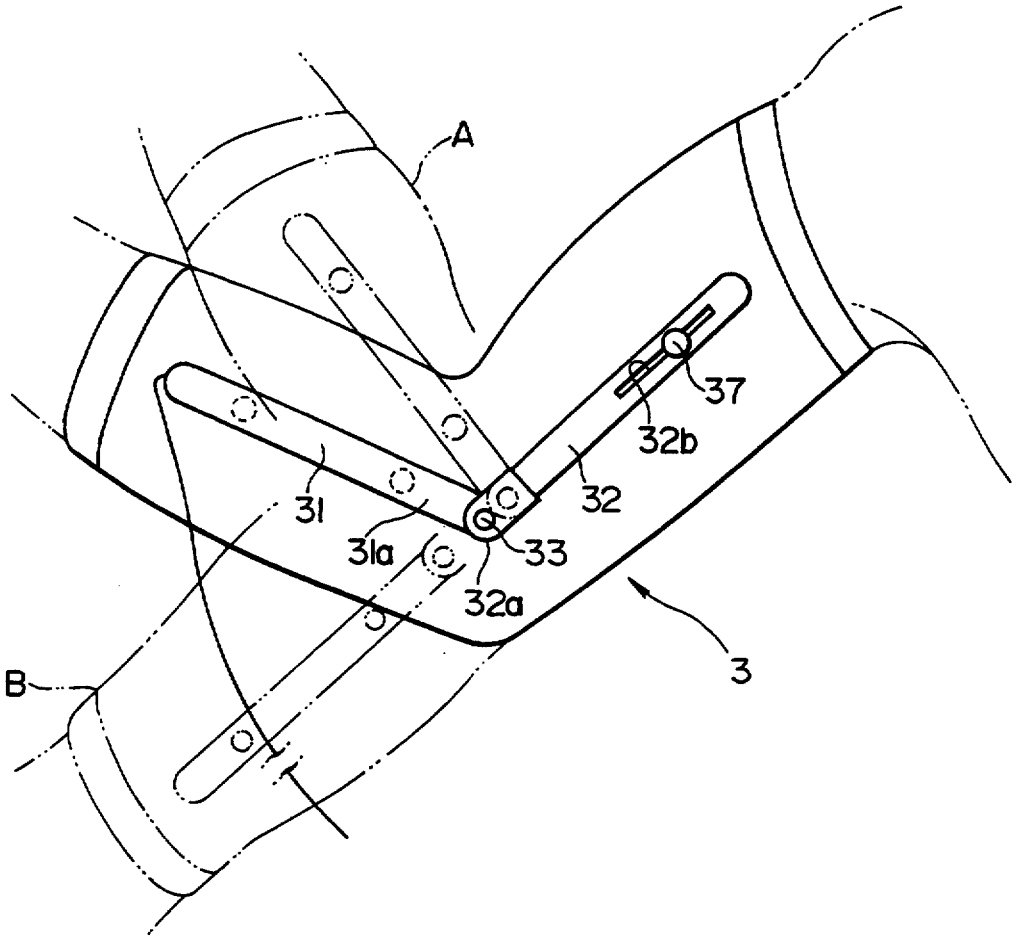
FIG. 6 is a side view of an elbow sensor of the present invention applied to a performer's arm.
Figure 7:
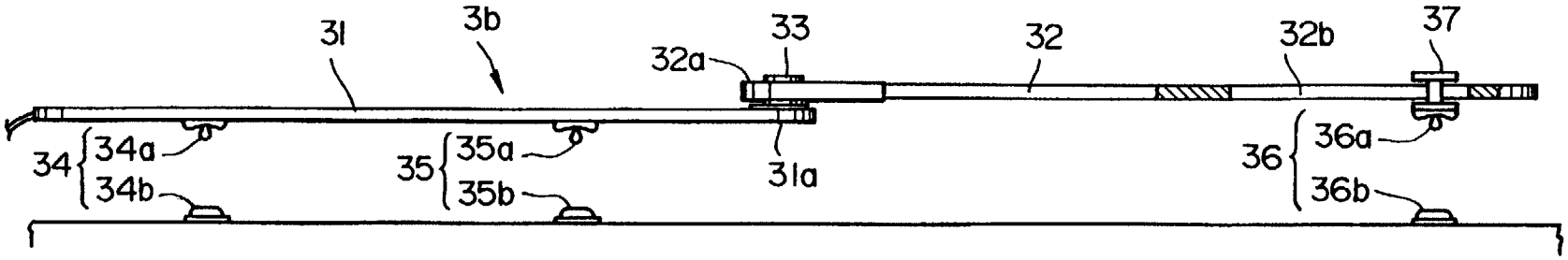
FIG. 7 is a side view of an angle sensor of the present invention.
Figure 8:
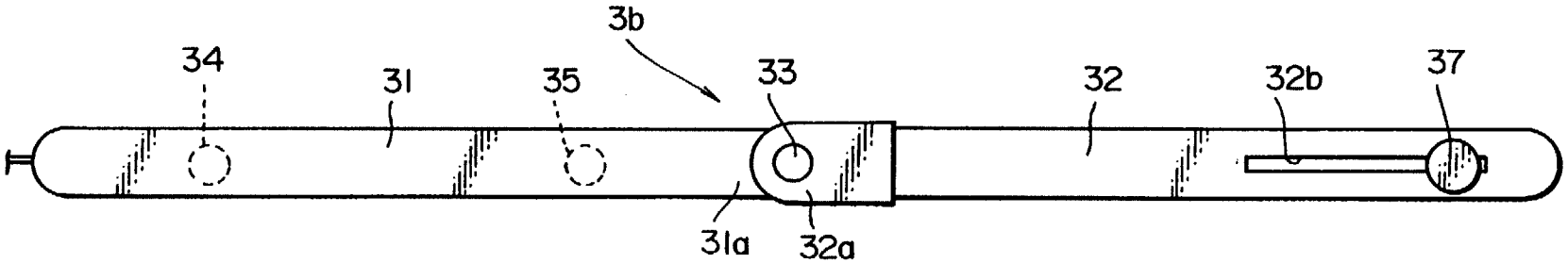
FIG. 8 is a plan view of the angle sensor shown in FIG. 7.

In FIG. 6, an elbow sensor 3 is shown attached to the arm of an operator. In FIGS. 7 and 8, a side view and a plan view respectively of an angle sensor 3*b* which forms a part of elbow sensor 3 are shown. The above mentioned angle sensor 3*b* is made of two elongated plates 31, 32, the medial ends of each of which, end 31*a* and end 32*a* respectively, are joined together via a pin 33 so that the plates 31, 32 are able to pivot freely in a plane with respect to one another. Via snaps 34, 35 and 36, the above described angle sensor 3*b* can be easily fastened and unfastened to sleeve 3*a*. Each snap 34, 35 and 36 is made up of a corresponding male snap portion 34*a*, 35*a* and 36*a* respectively, and female snap portion 34*b*, 35*b* and 36*b* respectively,. The above mentioned plates 31, 32 are fabricated from two elongated strips of plastic having approximately the same dimensions. The male snap portions 34*a* and 35*a* are each attached on the surface of plate 31 adjacent to sleeve 3*a*, and the corresponding female snap portions 34*b* and 35*b* are each attached at corresponding locations on the sleeve 3*a*. Male snap portion 36*a* is attached to the inner surface of a movable piece 37 provided so as to slide freely within an elongated groove 32*b* at the distal end of plate 32. A corresponding female snap portion 36*b* is provided on the upper part of sleeve 3*a*.

Figure 9:
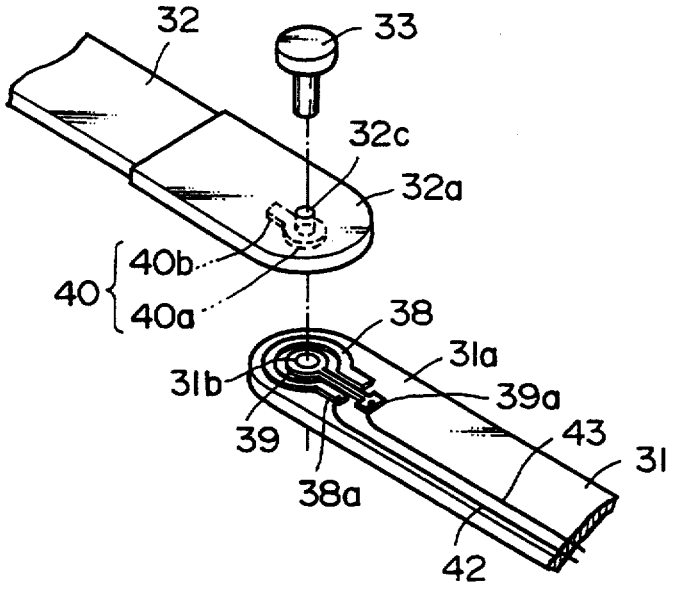
FIG. 9 is an oblique view of the partially disassembled essential components of an elbow sensor of the present invention.

Provided between the medial ends 31*a* and 32*a* of plates 31 and 32 at the portions of their surfaces at which they oppose one another, are a resistance loop 38, a fixed contact 39 and a sliding contact 40, as shown in FIG. 9, which function together as a potentiometer. Fixed contact 39 is attached to plate 31 surrounding hole 31*b* for pin 33, with resistance loop 38 also attached to plate 31 surrounding hole 31*b* somewhat peripheral to fixed contact 39, in an arc shaped configuration. Sliding contact 40 is attached to plate 32, with ring portion 40*a* of approximately the same diameter as fixed contact 39 surrounding hole 32*c* for pin 33. A protruding contact 40*b* of sliding contact 40 juts out from the ring portion 40*a*, whereby contact with resistance loop 38 on the opposing surface of plate 31 can be made. Thus, when plate 31 and plate 32 pivot with respect to one another about pin 33, fixed contact 39 and ring portion 40*a* of sliding contact 40 make constant electrical contact, while protruding contact 40*b* of sliding contact 40 slides along the opposing surface of resistance loop 38 constantly maintaining electrical contact therewith, thereby creating a variable resistance between terminals 38*a* and 39*a* of resistance loop 38 and fixed contact 39 respectively. Terminals 38*a* and 39*a* each connect with a lead 42 and 43 respectively.

Thus constructed, when the operators arm to which elbow sensor 3 is applied moves from the flexed position A to the fully extended position B shown in FIG. 6, plates 31 and 32 pivot about pin 33 with respect to one another, and operation of the above described potentiometer created by resistance loop 38, fixed contact 39 and sliding contact 40 is effected, thereby providing a variable resistances between leads 42 and 43 which corresponds to the extent of flexion or extension of the operators arm to which the elbow sensor is applied. Because snap 36 is connected with movable piece 37 which slides freely in groove 32*b*, there is no restriction of motion of the operators arm.

One of two of the above described elbow sensors is applied to each arm of an operator. In following discussions where there is a need to distinguish between the output of the left and right elbow sensors 3, the angle sensor of left elbow sensor 3 will be referred to as angle sensor 3*bl* and the angle sensor of right elbow sensor 3 will be referred to as angle sensor 3*br*.

Structure of Musical Tone Control Device GC

As can be seen in FIG. 1, the output of each right bending sensor R1–R5 is supplied to a register 50 in musical tone control device GC, wherein one bit corresponds to which each bending sensor R1–RS. The bit pattern supplied to register 50 is stored therein, then output to bus BS. Similarly, the output of each left bending sensor L1–L5 is supplied to a register 53 in musical tone control device GC, wherein one bit corresponds to which each bending sensor L1–LS. The bit pattern supplied to register 53 is stored therein, then output to bus BS. When the operator bends one of his/her digits such that the corresponding bending sensor changes from an [OFF] state to an [ON] state, the bit in sensor 50 or sensor 53 corresponding to that bending sensor is set to one. If the operator extends one of his/her digits such that the corresponding bending sensor changes from an [ON] state to an [OFF] state, the bit in sensor 50 or sensor 53 corresponding to that bending sensor is cleared to zero. Thus, based on the signals that are subsequently output from registers 50, 53, it can be judged whether the output from each bending sensor R1–R5, L1–L5 corresponds to an [OFF] state or to an [ON] state.

Again referring to FIG. 1, the analog output signal from angle sensor 3*br* is supplied to A/D converter 51. The digital output of A/D converter 51 is then supplied to register 52 where it is stored, then output to bus BS as angle data KDR. Similarly, the analog output signal from angle sensor 3*bl* is supplied to A/D converter 54. The digital output of A/D converter 54 is then supplied to register 55 where it is stored, then output to bus BS as angle data KDL.

In FIG. 1, it can be seen that in addition to registers 50, 52, 53, 55, also joined by bus BS is CPU (central processor unit) 70, ROM (read only memory) 71 which contains program memory for CPU 71, RAM (random access memory) 72 which serves as work area memory for CPU 70, timer 73, operation unit 74, as well as tone generator 75.

To explain the fundamental operation of the musical sound control device of the present invention as thus described, CPU 70 generates keycodes KC based on the output of registers 50 and 53. Thus, keycodes KC are generated based on the [ON]/[OFF] states of bending sensors R1–R5 and bending sensors L1–L5. In Table 1 below, the relationship between generated keycodes and the [ON]/[OFF] states of the various bending sensors is shown.

TABLE I

| | R1 ON | R2 ON | R3 ON | R4 ON | R5 ON |
|---|---|---|---|---|---|
| L1 - ON | C | D | E | F | G |
| L1 - OFF | F | G | A | B | C* |
| L2 - ON | | | # | | |
| L3 - ON | | | ♭ | | |
| L4 - ON | | | up one octave | | |
| L5 - ON | | | down one octave | | |

As can be seen in Table 1, when for example bending sensors R2 and L1 are both in the [ON] state, the keycode KC corresponding to the musical tone of D ("re") in the standard octave is generated. When bending sensor R3 is in the [ON] state, and bending sensor L1 is in the [OFF] state, the keycode KC corresponding to the musical tone of A ("ra" ) in the standard octave is generated. When bending sensors R1, L1 and L2 are all in the [ON] state, the keycode KC corresponding to the musical tone of C# in the standard octave is generated. When bending sensors R1, L1, L2 and L4 are all in the [ON] state, the keycode KC corresponding to the musical tone of C# one octave above the standard octave is generated. In table one, the entry C* indicates the tone of C one octave above the standard octave.

When CPU 70 is supplied a signal from register 52, that is, a digital signal from register 52 based on an analog signal from angle sensor 3*br*, a corresponding pitch bender control data value PD is generated in CPU 70. Similarly, when CPU 70 is supplied a signal from register 55, that is, a digital signal from register 55 based on an analog signal from angle sensor 3*bl*, a corresponding vibrato control data value VD is generated. The above described pitch bender control data values PD and vibrato control data value VD generated in CPU 70 is then supplied to tone generator 75.

The above mentioned timer 73 supplies an interrupt signal IR to CPU 70 at a fixed frequency. The above mentioned operation unit 74 which is connected with CPU 70 via bus BS includes a power switch, timbre designation switches and the like. The above mentioned tone generator 75 receives control data from tone CPU 70 via bus BS, whereby a music signal corresponding to the supplied control data is supplied to sound system 76. Sound system 76 includes amplifiers, speakers and the like and generates actual musical sound based on the supplied music signal from tone generator 75.

In the following, actual operation of the musical sound control device of the present invention will be described with reference to the flow charts of FIGS. 10 and 11.

First of all, the operator dons the left and right finger sensors 2 and elbow sensors 3. Next, the electrical power switch is turned on, whereby the initial processing in step S1 of the flow chart in FIG. 10 is initiated. Thus, in step S1, CPU 70 effects the clearing of registers 50, 52, 53 and 55, and the initial setting of the various registers in tone generator 75 . Next in step S2, output data from registers 50 and 53 are written to RAM 72. In step S3, based on the data written to RAM 72 in the preceding step, a judgement is made as to whether any of the bending sensors L1-L5, R1-R5 have changed from the [OFF] state to the [ON] state. When the result of the judgement in step S3 is [YES] , the routine proceeds to step S4 where sensor on-event processing is effected. In the above mentioned sensor on-event processing, based on the [ON]/ [OFF] state of each of the bending sensors L1-LS, R1-RS, a corresponding keycode KC is generated in CPU 70, after which the generated keycode KC is supplied to tone generator 75. Based on the keycode KC supplied to tone generator 75, a music signal of corresponding pitch is generated which is then supplied to sound system 76.

On the other hand, when the result of the judgement in step S3 is [NO], the routine proceeds to step S5 where a judgement is made as to whether any of the bending sensors L1-L5, R1-R5 have changed from the, [ON] state to the [OFF] state. When the result of the judgement in step S5 is [YES], the routine proceeds to step S6 where sensor off-event processing is effected. In the above mentioned sensor off-event processing, when it is determined that at least one of the bending sensors L1-LS, R1-F5 are in the [ON] state, based on the [ON] / [OFF] state of each of the bending sensors L1-L5, R1-R5 at the current point in time, a corresponding keycode KC is generated in CPU 70, after which the generated keycode KC is supplied to tone generator 75. In this way, based on the keycode KC supplied to tone generator 75, a music signal of a pitch corresponding to the new [ON]/[OFF] state of each of the bending sensors L1-L5, R1-R5 is generated which is then supplied to sound system 76. In the event that all of the bending sensors L1-L5, R1-R5 are in the [OFF] state, a key-off signal is supplied to tone generator 75, whereby tone generation is terminated. The processing in CPU 70 then returns to step S2, and the above described routine repeats . When the result of the judgement in step S5 is [NO], the routine returns immediately to step S2.

In the following, an explanation will be given concerning the above mentioned interrupt signal IR. When CPU 70 receives an interrupt signal IR from timer 73, CPU 70 jumps to step S11 of the interrupt processing routine shown in the flow chart of FIG. 11. In step S11, angle data KDR from register 52 is written to RAM 72. Then, in step S12, pitch bender control data PD is formed corresponding to the angle data KDR stored in RAM 72 and the pitch bender control data PD is stored in RAM 72 as well.

Concerning the relationship between the above mentioned angle data KDR and pitch bender control data PD, assuming that angle data KDR is given in degrees, when the angle data KDR is greater than or equal to 60° and less than or equal to 120°, a value of zero is written to RAM 72 as pitch bender control data PD . When KDR is greater than 120°, the value for pitch bender control data PD is given by Equ. 1 below:

$$PD=(KDR-120\times 100/60 \quad (1)$$

When KDR is less than 60°, the value for pitch bender control data PD is given by Equ. 2 below:

$$PD=(\mathrm{KDR}-60)\times 100/30 \quad (2)$$

When the values for pitch bender control data PD are determined by the above Equ. 1 and Equ. 2, the calculated values are then written to RAM 72. In the above discussion, the values for the pitch bender control data PD correspond to the angle formed between the operators upper arm and forearm at the elbow. Thus, 180° represents full extension of the operators arm.

Next, in step S13, the pitch bender control data PD written to RAM 72 in the preceding step is supplied to tone generator 75. As a result, the pitch of the musical tone currently being generated is subjected to pitch bender control corresponding to the value for the pitch bender control data PD supplied to tone generator 75. When the pitch bender control data PD is positive, the resulting pitch bender effect causes the generated pitch to be shifted to a higher pitch, whereas when the pitch bender control data PD is negative, the generated pitch is shifted to a lower pitch. In the present embodiment, the units for the pitch bender control data are given by 1/100 of a half step. Thus, for a pitch bender control data value of 20, the pitch is shifted upward by 20/100 of a half step. For a pitch bender control data value of −35, the pitch is shifted downward by 35/100 of a half step.

As can be understood from the above discussion, as the operators right elbow flexes from 120° of flexion to the point of maximal extension (180°), the value for the pitch bender control data PD calculated by Equ. 1 progressively increases from 0 to 100, corresponding to an upward shift in pitch ranging from no shift to a shift of one half step. Within the range of 60° to 120°, no pitch bending is effected. For angles in the range of from 60° to 30° (near maximal flexion), the value for the pitch bender control data PD calculated by Equ. 2 progressively decreases from 0 to −100, corresponding to a downward shift in pitch ranging from no shift to a shift of one half step. It can be seen that the range of 60° to 120° constitutes an example of the non-sensing region referred to in the Summary of the Invention.

Returning again to the discussion concerning FIG. 11, after determining the pitch bender control data PD and writing it to RAM 72, the routine proceeds to step S14 where angle data KDL from register 55 is written to RAM 72. Then, in step S12, ribrato control data VD is formed corresponding to the angle data KDL stored in RAM 72 and the vibrato control data VD is stored in RAM 72 as well.

Concerning the relationship between the above mentioned angle data KDL and vibrato control data VD, assuming that angle data KDL is given in degrees, when the angle data KDL is greater than or equal to 90° a value of zero is written to RAM 72 as vibrato control data VD. When KDL is less than 90°, the value for vibrato control data VD is given by Equ. 3 below:

$$VD=(90-KDL)\times 20/60 \quad (3)$$

After the value for ribrato control data VD is calculated by the above Equ. 3, the calculated value is then written to RAM 72.

Next, in step S16, the vibrato control data VD written to RAM 72 in the preceding step is supplied to tone generator 75. As a result, the pitch of the musical tone currently being generated is subjected to vibrato control corresponding to the value for the ribraro control data VD supplied to tone generator 75. In the present embodiment, the units for the vibrato control data VD represent a vibrato effect having a depth of 1/100 of a half step. Thus, for a vibrato control data value of 10, the effected vibrato has a depth of 10/100 of a half step. After completion of step S16, CPU 70 returns to the execution of the main routine shown in the flow chart of FIG. 10.

As can be understood from the above discussion, as the operators right elbow flexes from 90° to 30° of flexion, the value for the vibrato control data VD calculated by Equ. 3 progressively increases from 0 to 20, corresponding to a vibrato effect ranging from no vibrato to a vibrato effect having a depth of 20/100 of a half step. It can be seen that the range of 90° and greater constitutes an example of the non-sensing region referred to in the Summary of the Invention.

Second Preferred Embodiment

In the above described first preferred embodiment of the present invention, values for the pitch bender control data PD were calculated from angle data KDL using Equ. 1 and Equ. 2, and values for the vibrato control data VD were calculated from angle data KDR using Equ. 3. In a second preferred embodiment of the present invention, values for the pitch bender control data PD are determined from angle data KDL, and values for the vibrato control data VD are determined from angle data KDR using respective conversion tables. Otherwise, the first and second preferred embodiments are essentially the same.

Third Preferred Embodiment

In the following, a third preferred embodiment of the present invention will be described with reference to FIGS. 12 through 19.

Figure 12:
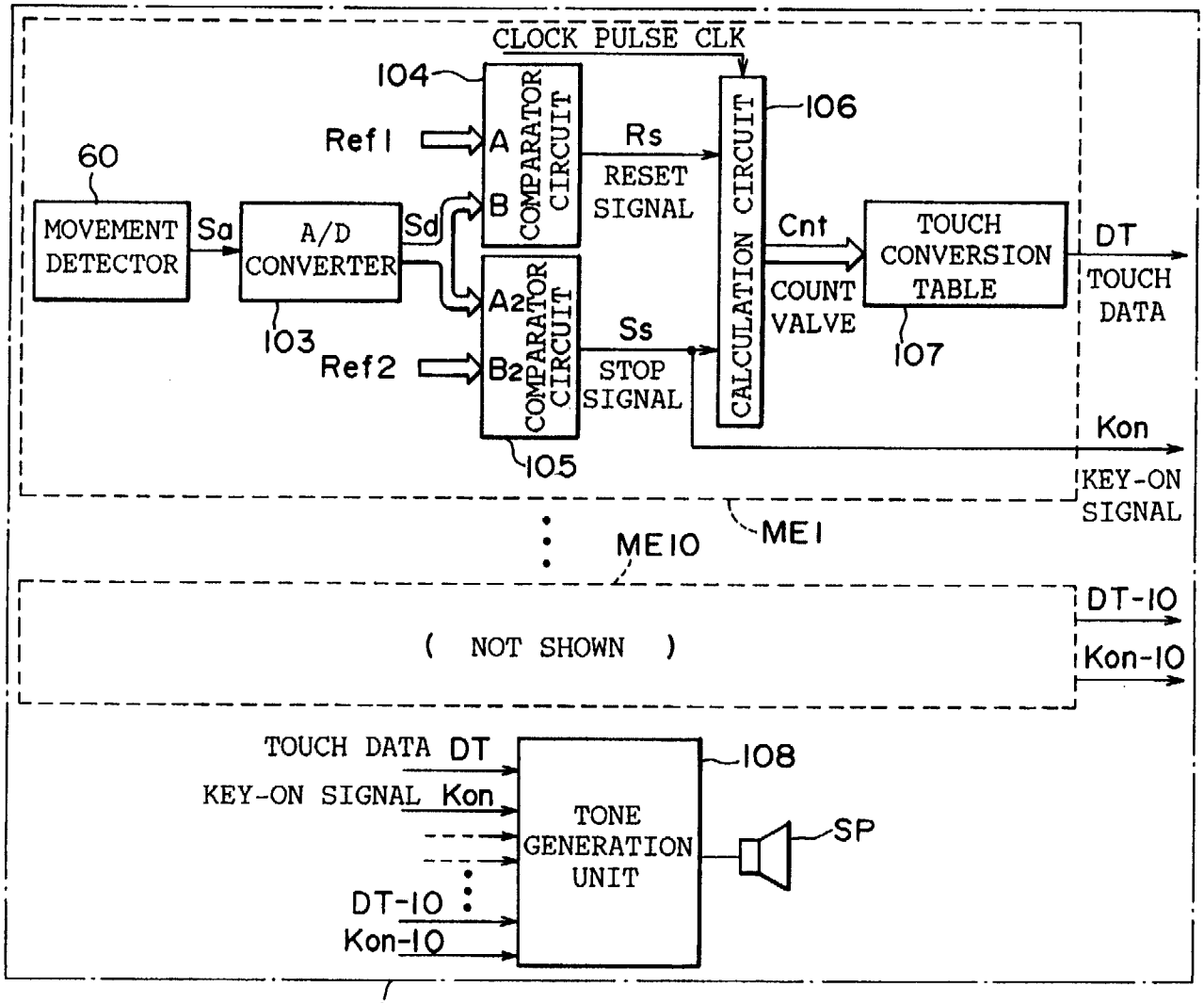
FIG. 12 is a block diagram showing the layout of a musical sound control device of a third preferred embodiment of the present invention.

In FIG. 12, a block diagram is presented showing the overall layout of the musical tone control device MG of the present embodiment. In the drawing, it can be seen that musical control units ME1 through ME10 are provided (musical control units ME2 through ME10 are shown in abbreviated form), one corresponding to each digit of the operators two hands. The output from each musical control unit ME1–ME10 is supplied to a single tone generation unit 108, the output of which is in turn supplied to a speaker SP. As can be seen in FIG. 12, each musical control unit ME1–ME10 includes a movement detector 60 for the corresponding digit. The structure components of a representative example of a movement detector 60 is shown in FIG. 13.

Figure 13:
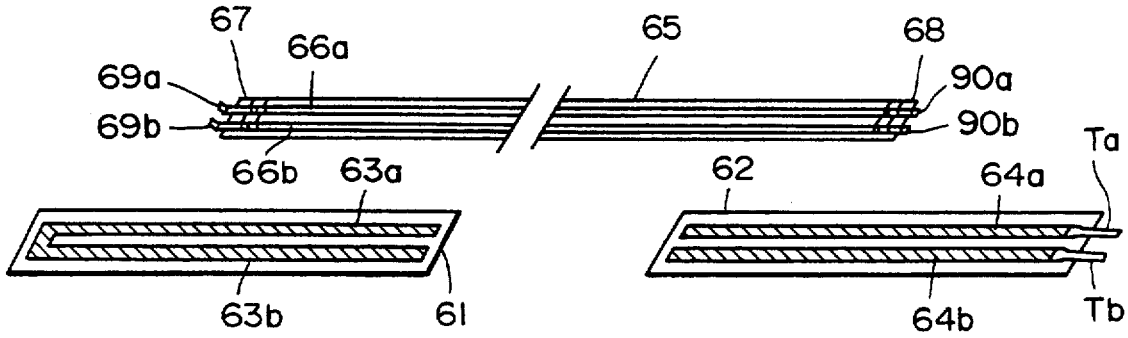
FIG. 13 is an oblique view showing the structure of a movement sensor employed in the third preferred embodiment of the present invention.

Referring to FIG. 13, it can be seen that each movement detector 60 includes two resistance strips 61, 62 in the form of thin, elongated bands. On the upper surface of resistance strip 61, two elongated carbon resistance elements 63*a*, 63*b* are provided side by side, aligned parallel to the longitudinal axis of the resistance strip 61. At one end of the resistance strip 61, the two carbon resistance elements 63*a*, 63*b* join in the form of a "U". On the upper surface of resistance strip 62, two elongated carbon resistance elements 64*a*, 64*b* are provided side by side, aligned parallel to the longitudinal axis of the resistance strip 61. At one end of the resistance strip 61, two terminals Ta, Tb are provided, each connected with a respective one of the two carbon resistance elements 64*a*, 64*b*. A sliding strip 65 is provided formed from plastic, on the upper surface of which, two elongated flexible conductor strips 66*a*, 66*b* are provided in a parallel arrangement, aligned along the longitudinal axis of the sliding strip 65. (It should be noted that FIG. 13 is not proportionate, and hence the size of resistance strips 61, 62 is much smaller compared with sliding strip 65 than is indicated in the drawing.) An insulating brush support 67, 68 formed from a thin strip of plastic is provided at either end of sliding strip 65. The above described conductor strips 66*a*, 66*b* are such that they extend up to and over the terminal ends of the two brush supports 67, 68 at the ends of sliding strip 65. At one end of sliding strip 65, two brushes 69*a*, 69*b* are provided mounted on brush support 67, one of each of the two brushes 69*a*, 69*b* connecting with a respective one of the two conductor strips 66*a*, 66*b*. At the other end of sliding strip 65, two brushes 90*a*, 90*b* are provided mounted on brush support 68, one of each of the two brushes 90*a*, 90*b* connecting with a respective one of the two conductor strips 66*a*, 66*b* at their ends opposite to the ends where brushes 69*a*, 69*b* are connected. The above described brushes 69*a*, 69*b* are in sliding contact with resistance elements 63*a*, 63*b*, respectively, in the assembled movement detector 60, and brushes 90*a*, 90*b* are in sliding contact with resistance elements 64*a*, 64*b*, respectively.

Figure 14:
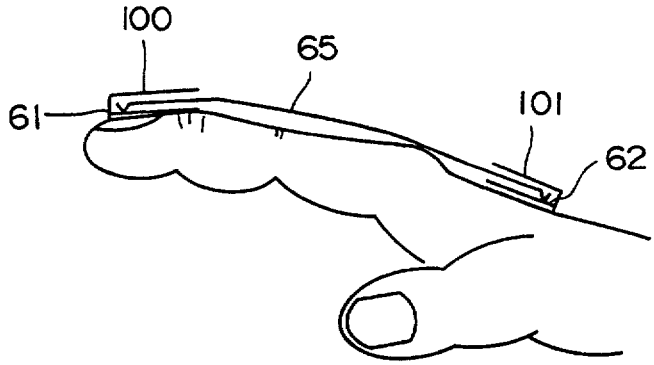
FIG. 14 and 15 are drawings showing the movement sensor illustrated in FIG. 13 in use.

Referring to FIG. 14, two casings 100, 101 can be seen that are mounted in proximity to the tip and base, respectively, of a corresponding digit of the performer's hand, each casing 100, 101 having one end that is open. As shown in the FIG. 14, the two casings 100, 101 are positioned so that the openings thereof each oppose one another when the operator's corresponding digit is extended. The above described resistance strip 61 is fitted in casing 100, attached to the upper aspect of the surface thereof which is adjacent to the operators corresponding digit. Similarly, resistance strip 62 is fitted in casing 101, attached to the upper aspect of the surface; adjacent to the operators digit. Each end of the above described sliding strip 65 is fitted into a respective casing 100, 101 so as to slide freely therein, in such a way that brushes 69*a*, 69*b* make sliding contact with resistance elements 63*a*, 63*b*, respectively, and so that brushes 90*a*, 90*b* make sliding contact with resistance elements 64*a*, 64*b*, respectively.

Figure 15:
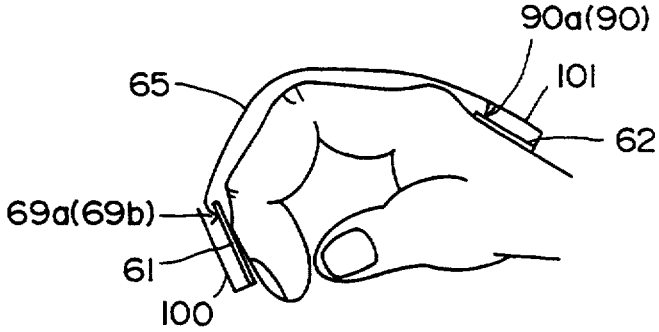

As can be seen in FIG. 15 when one of the operator's digits flexes on which one of the above described movement detectors 60 has been applied, the distance between the two casings 100, 101 along the dorsal surface of the corresponding digit increases. As a result, brushes 69*a*, 69*b* and brushes 90*a*, 90*b* come to be displaced toward the openings of their respective casings 100, 101. Thus, to the extent that the operator's digit flexes, brushes 69*a*, 69*b* and brushes 90*a*, 90*b* become displaced along the surfaces of resistance strips 61, 62 toward the openings of their respective casings 100, 101.

Figure 16:
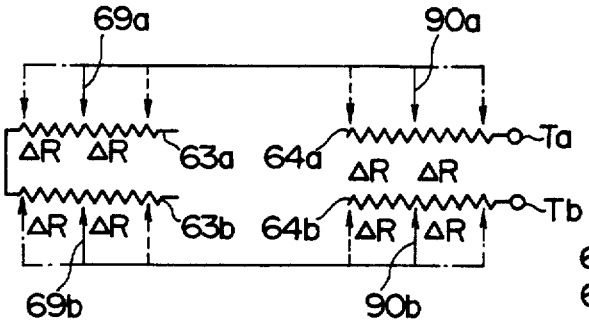
FIG. 16 is a circuit diagram which schematically illustrates the electrical layout of the movement sensor shown in FIGS. 13 through 15.

In FIG. 16, the electronic structure of a movement detector 60 is schematically illustrated, wherein the indicating numerals identify elements corresponding to each of the components shown in FIG. 13. In the drawing, brushes 69*a*, 69*b*, 90*a*, and 90*b* are indicated by a solid line when the corresponding digit is in a partially flexed position, by a dotted line for a fully extended position, and by a dashed line for a fully flexed position.

It can be seen in FIG. 16 that, to the extent the operator's corresponding digit flexes, the total length of resistance elements 63*a*, 63*b*, 64*a* and 64*b* intervening between terminals Ta and Tb increases. Thus, assuming that the resistance indicated by each $\Delta R$ in FIG. 16 is constant, when the operator's corresponding digit is fully extended, the resistance across terminals Ta and Tb is essentially zero. In a partially flexed position, the resistance is $4\Delta R$, in a fully flexed position, the resistance is $8\Delta R$.

Figure 17:
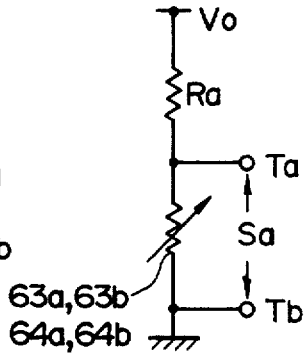
FIG. 17 is a circuit diagram which schematically illustrates the variable resistance effect achieved by the movement sensor shown in FIGS. 13 through 16.

In FIG. 17, the effect achieved by a movement detector 60 is schematically represented as a variable resistance. In this drawing, a voltage $V_0$ is shown to be applied across terminals Ta and Tb after first passing through resistance $R_a$. A movement detector signal $S_a$ is output from the movement detector 60 which corresponds to the extent that the operator's digit has flexed. Referring back to FIG. 12, it can be seen that this movement detector signal $S_a$ is supplied to an A/D converter 103. In A/D converter 103, the analog movement detector signal $S_a$ is converted to a digital signal, which is then supplied to comparator circuits 104, 105 as displacement data $S_d$. In comparator circuit 104 the supplied displacement data $S_d$ is compared with a reference signal REF1, and in comparator circuit 105, the supplied displacement data $S_d$ is compared with a reference signal REF2, where the value for REF2 is creater than the value for REF1. When displacement data $S_d$ is judged to be greater than or equal to reference signal REF1, comparator circuit 104 outputs an "H" level reset signal (pulse signal) $R_s$ to calculation circuit 106. When displacement data $S_d$ is judged to be greater than or equal to reference signal REF2, comparator circuit 105 outputs an "H" level stop signal (continue signal) $S_s$ to calculation circuit 106. Additionally, the above mentioned stop signal $S_s$ is supplied from comparator circuit 105 to tone generation unit 108 as a key-on signal KON. After calculation circuit 106 has been reset by a reset signal $R_s$ from comparator circuit 104, a counting of clock pulse CLK is started in calculation circuit 106. When calculation circuit 106 receives a stop signal $S_s$ from comparator circuit 105, the counting of clock pulse CLK is terminated and the count value Cnt at that point in time is output from calculation circuit 106 to touch conversion table 107 where it is converted to touch data DT. Thus, the output count value Cnt supplied to touch conversion table 107 represents the velocity of the finger to which the corresponding movement detector 60 is applied. Touch conversion table 107 is comprised of a plurality of separate tables, each one corresponding to a respective digit among the operators eight fingers and two thumbs. In this way, touch conversion table 107 converts the supplied count value Cnt to touch data DT which is then supplied to tone generation unit 108, the touch data DT indicating the strength (touch intensity) of the motion of the respective digit.

Figure 18:
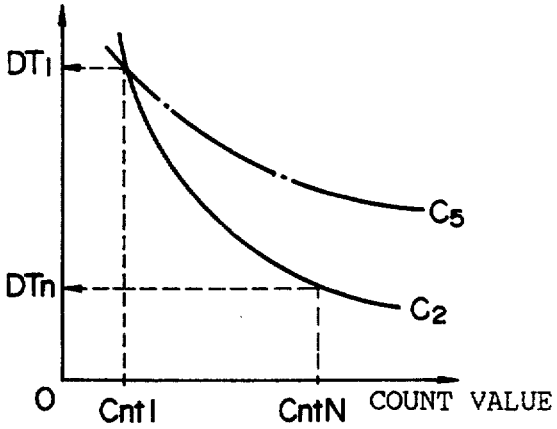
FIG. 18 is a graph showing the relationship between count value Cnt and touch data DT in the third preferred embodiment of the present invention.

FIG. 18 is a graph showing the relationship between count value Cnt and touch data DT. In this graph, the X-axis resents count values Cnt ranging from Cntl to Cntn, and the Y-axis represents touch data DT ranging from DT1 to DTn, where each count value Cnt corresponds to a respective value of the touch data DT. In the graph, count values Cntl and Cntn represent relatively fast and relatively slow digit movement, respectively, and as defined by curve C2, the corresponding touch data DT values are DT1 and DTn, respectively. Thus, when a touch data DT value ranging from DT1 to DTn is supplied to touch conversion table 107 as address data, the corresponding count value Cnt ranging from Cntl to Cntn recorded in touch conversion table 107 is read out.

While the above discussion has concerned musical control unit ME1, the structure and function of musical control units ME2 through ME10 are the same. In the present preferred embodiment, the movement detectors 60 for musical control units ME1 through ME5 correspond to the operators right thumb, index finger, middle finger, ring finger and small finger respectively, and those for musical control units ME6 through ME10 correspond to the operators left thumb, index finger, middle finger, ring finger and small finger respectively. For each musical control unit ME1 through ME10, the corresponding values for reference signal REF1 and reference signal REF2 can be independently varied, as can the form of the curve stored in touch conversion table 107 for the respective digit. In this way, it is possible to adjust the response characteristics of the movement detectors 60 for each musical control unit ME1 through ME10 to match the different speed and agility characteristics of each of the performer's ten digits. Thus, in FIG. 18, curves C2 and C5 represent the performer's right index and small fingers respectively.

Figure 19:
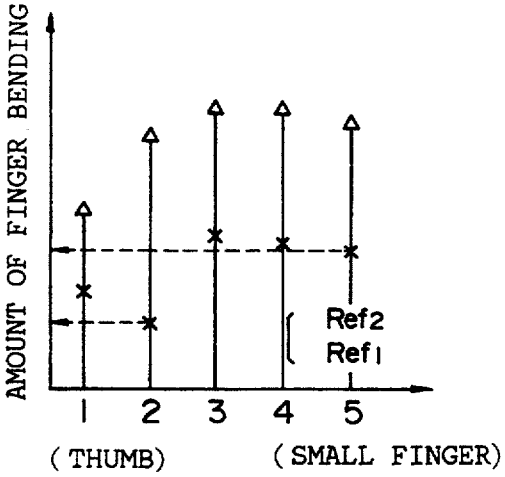
FIG. 19 is a bar graph showing examples of reference signal REF1 and reference signal REF2 in the third preferred embodiment of the present invention converted to analog values.

FIG. 19 is a bar graph showing examples of reference signal REF1 and reference signal REF2 in the present embodiment of the present invention, converted to analog values. Along the X-axis in the graph, numerals 1 through 5 indicate the performer's right thumb through index finger respectively. The Y-axis indicates the amount of flexion for each of the performer's corresponding digits. For each digit shown, the points corresponding to reference signals REF1 and REF2 are indicated by an X and a triangle respectively.

In the case of the performer's right index finger ($i=1$), this digit ordinarily is strong and can move quickly. Accordingly, reference signal REF1 is set to a comparatively low value and reference signal REF2 is chosen so that the difference between reference signal REF1 and reference signal REF2 is comparatively great. On the other hand, with the performer's right small finger ($i=5$), which is ordinarily much weaker than the index finger, reference signal REF1 is set to a comparatively high value and reference signal REF2 is chosen so that the difference between reference signal REF1 and reference signal REF2 is comparatively small. Reference signals REF1 and REF2 are selected for musical control units ME6 through ME10 corresponding to the operators left digits based on the same considerations.

When tone generation unit 108 receives a key-on signal KON from any of musical control units ME1 through ME10, a tone corresponding to a note of a musical scale is generated. Thus, for example, when the operator's right thumb flexes, tone generation unit 108 generates a [do], when the operator's right index finger flexes, a [re] is generated, when the operator's left index finger flexes, a [ti] is generated, etc. Additionally, based on the velocity of the flexing digit, the volume of the corresponding tone is controlled.

Next, the operation of the musical sound control device of the present embodiment will be described. First of all, each end of each of the ten sliding strips 65 is fitted into a respective casing 100, 101, after which each of the casings 100 are each fitted on the performer's hand adjacent to a respective finger tip, and each of the casings 101 are each fitted on the performer's hand adjacent to the base of a respective finger. Then, as the performer begins to move his/her fingers and thumbs, corresponding to the flexing of a given digit, the respective movement detector 60 outputs a movement detector signal $S_a$. Then based on the movement detector signals $S_a$ generated according to the movement of the performer's digits, each musical control unit ME1 through ME10 converts its corresponding movement detector signals $S_a$ into key-on signals KON and touch data DT.

Then, based on the key-on signals KON supplied from each each musical control unit ME1 through ME10, tone generation unit 108 generates tones corresponding to the notes of a musical scale, and according to the supplied touch data DT, controls the volume of the generated tones. As a result, because the mobility and dexterity of each of the five digits of the performer's hands have been taken into consideration, a performance incorporating touch intensity musical control is effected.

Fourth Preferred Embodiment

Figure 20:
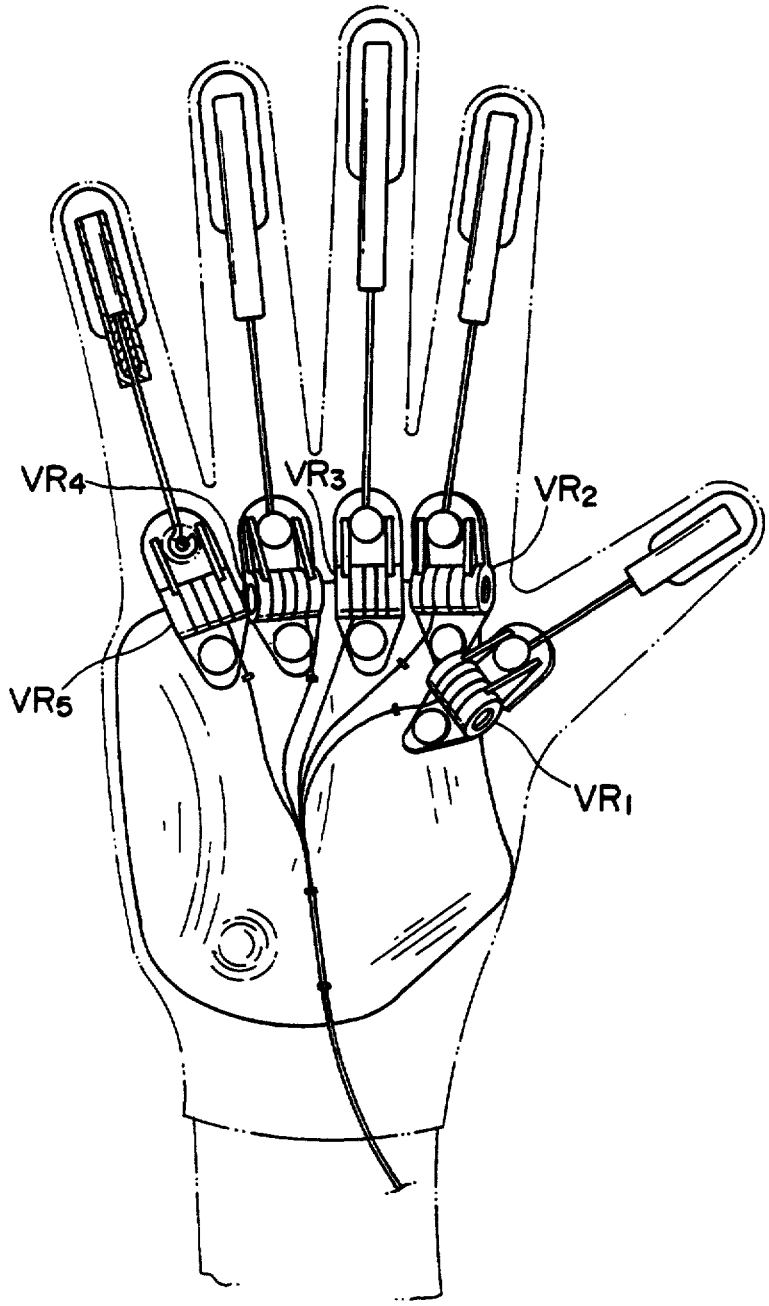
FIG. 20 is a plan view showing the structure of a movement sensor employed in the fourth preferred embodiment of the present invention.

In the above described third preferred embodiment of the present invention, a respectoive movement detector 60 was applied to the dorsal surface of each of the performer's ten digits, however, it is also suitable to use a glove type movement detector as is shown in FIG. 20. In the example shown in FIG. 20, a variable resistor VR1 through VR5 is provided adjacent to each metacarpal-phalangeal of the performer's right hand, whereby flexion of the respective digit is detected.

In the above described embodiments of the present invention, the embodiments described should be regarded as suitable examples and not as limitations. Thus, the present invention should be considered to include all embodiments encompassed by the appended claims.

What is claimed is:

1. A musical sound control device comprising:

a) detection means, attached to one or more portions of a human body, for detecting movement of said body portions to thereby create an output signal responsive to said movement of said body portions, said output signal varying over a range of values;

b) control signal generation means for, in response to the output signal of said detection means generating a musical tone control signal, such that when said output signal is in a predetermined region within said range said musical tone control signal does not reflect the change of said output signal, and when said output signal lies within said range on either side of the predetermined region said musical tone control signal varies in response to the change of said output signal; and c) musical tone generating means for generating musical tones based on said musical tone control signal.

2. A musical sound control device in accordance with claim 1 wherein the control signal generation means further comprises means for carrying out a conversion of said output signal into said musical tone control signal when said output signal lies outside of said predetermined region.

3. A musical sound control device in accordance with claim 1 wherein said control signal generation means generates a musical control signal by performing predetermined calculations on the output of said detection means.

4. A musical sound control device in accordance with claim 1 wherein said control signal generation means includes stored data tables and generates a musical control signal according to the output of said detection means by employing said stored data tables.

5. A musical sound control device in accordance with claim 1 wherein said body portions include an elbow and wherein at least one of said detection means is an elbow sensor of which the output varies continuously based on the angle formed by said elbow.

6. A musical sound control device in accordance with claim 1 wherein said body portions include an elbow and wherein said control signal generation means generates pitch bender control data according to the output of said detection means based on the angle formed by said elbow.

7. A musical sound control device in accordance with claim 1 wherein said body portions include an elbow and wherein said control signal generation means generates vibrato control data according to the output of said detection means based on the angle formed by said elbow.

8. A musical sound control device in accordance with claim 1 wherein said body portions include one or more digits of a person's hand and at least one of said detection means is a finger sensor which outputs on-signals and off-signals based on the position of a respective digit.

9. A musical sound control device in accordance with claim wherein said control signal generation means generates keycodes corresponding to the on signals and off signals output from said at least one finger sensor.

10. A musical control device for use by an operator comprising:

a) a plurality of movement detector means for detecting movement, applied to a plurality of the digits of the operator's hands, respectively, whereby movement of said digits is detected, thereby creating an output signal for each of said digits;

b) calculation means, including means for providing a plurality of reference signals, which reference signals are different for at least two of said respective digits, for calculating calculation values in accordance with the output signals from said movement detector means and said reference signals; and c) conversion means for converting said calculation values to a variable music control signal for each of said movement detector means 11. A musical sound control device in accordance with claim 10 wherein said conversion means outputs touch data corresponding to said calculation values.

12. A musical sound control device in accordance with claim 10 wherein said calculation means outputs a key-on signal when said output signal from said movement detector means is greater than a corresponding reference signal.

13. A musical sound control device in accordance with claim 10 wherein said calculation means is a counter.

14. A musical sound control device in accordance with claim 10, wherein said calculation means calculates the calculation values by comparing each of the output signals with a first reference signal and a second reference signal only when said output signal from said movement detector means is greater than said first reference signal and less than said second reference signal.

15. A musical sound control device for use by an operator comprising:

a) first designating means, applied to a plurality of the digits of the operator's hands, for designating plural notes of the scale of a musical tone, each note corresponding to activation of a single digit;

b) second designating means, applied to at least one of the digits of the operator's hands, for designating the pitch and tone range of the musical tone; and c) musical tone generating means for generating musical tones based on the notes designated by said first designating means and the designated pitch and tone range designated by said second designating means.

16. A musical sound control device in accordance with claim 15 wherein said second designating means designates the octave of the musical sound.

17. A musical control device for use by an operator comprising:

a) a plurality of movement detector means for detecting movement, applied to a plurality of th digital of the operator's hands, respectively, whereby movement of said digits is detected, thereby creating an output signal for each of said digits;

b) calculation means for producing a touch response signal having a value corresponding to the speed at which the value of said output signal varies in a reference zone determined by at least one predetermined value; and conversion means for converting said touch response signal to a variable music control signal for each of said movement detector means.

* * * * *